US005152676A

United States Patent [19]

Ohi

[11] Patent Number: 5,152,676

[45] Date of Patent: Oct. 6, 1992

[54] ASPIRATOR FAN

[75] Inventor: Shinichi Ohi, Konan, Japan

[73] Assignee: Zexel Corporation, Tokyo, Japan

[21] Appl. No.: 730,987

[22] Filed: Jul. 16, 1991

[30] Foreign Application Priority Data

Jul. 16, 1990 [JP] Japan ..... 2-75308[U]

[51] Int. Cl.[5] ..... F04D 25/06; F04D 29/42

[52] U.S. Cl. ..... 417/354; 417/423.1; 417/423.7; 417/423.14; 416/133; 416/140; 416/204 R

[58] Field of Search ..... 417/354, 423.1, 423.7, 417/423.12, 423.14, 424.1, 32; 416/133, 135, 204 R, 206; 415/140

[56] References Cited

U.S. PATENT DOCUMENTS 4,128,364 12/1978 Papst ..... 417/354

4,773,828 9/1988 Hagiwara ..... 417/354

FOREIGN PATENT DOCUMENTS 2524061 9/1976 Fed. Rep. of Germany ..... 417/424

*Primary Examiner*—Leonard E. Smith

*Assistant Examiner*—Roland McAndrews

*Attorney, Agent, or Firm*—Wenderoth, Lind & Ponack

[57] ABSTRACT

An aspirator fan is disclosed, which comprises a rotating shaft press-fitted in an impeller, a support member having an urging means and receiving one end of the rotating shaft for supporting the rotating shaft as a cantilever, and a shaft abutment member disposed in a casing and having a shaft abutment portion against which the opposite end of the rotating shaft is urged by the force of the resilient means. The aspirator fan is free of an alignment adjustment between the rotating shaft and bearings which is required in the casing of conventional aspirator fans. The shaft abutment member is structurally separated from the casing, so that even when the casing is deformed, a deformation of the casing has no effect on the rotation of the rotating shaft. The aspirator fan can, therefore, be operable with an improved reliability.

6 Claims, 1 Drawing Sheet

ASPIRATOR FAN

BACKGROUND OF THE INVENTION

1. Field of the Invention

The present invention relates to an aspirator fan particularly suitable for use in air-conditioners for motor vehicles.

2. Description of the Prior Art

Conventional aspirator fans of the type concerned include a rotor or impeller fixed on a rotating shaft which is supported by a pair bearings at its opposite ends. One example of such aspirator fans is disclosed in Japanese Utility Model Laid-open Publication No. 64-39118.

Since the rotating shaft is supported at its opposite ends as stated above, the two bearings must be accurately aligned with each other.

The bearings are firmly secured to a casing. As a consequence of this united or integral construction, when the casing is subjected to external forces or heat, central holes in the respective bearings are likely to displaced, thus hindering smooth rotation of the rotating shaft.

In order to prevent deformation of the casing, the casing must be formed of a highly rigid and thermally undeformable material. An alignment between the two bearings may be maintained by enlarging a clearance between the rotating shaft and the bearings. An enlarged clearance would, however, cause wobbling of the rotating shaft and the impeller, thus resulting in the generation of unpleasant noise.

SUMMARY OF THE INVENTION

With the foregoing difficulties of the prior art in view, it is an object of the present invention to provide an aspirator fan which includes a simple support structure for a rotating shaft and is capable of rotating reliably without causing displacement of the rotating shaft.

According to the present invention, there is provided an aspirator fan which comprises: a casing having an inlet and an outlet; an impeller having a magnet secured thereto; a rotating shaft press-fitted in the impeller to support the impeller for co-rotation therewith; a support member formed on the casing and receiving therein one end of the rotating shaft; means disposed in the support member for urging the one end of the rotating shaft toward an opposite end of the rotating shaft; a shaft abutment member disposed in the casing and held in engagement with the opposite end of the rotating shaft being urged by the urging means; a driver coil confronting the magnet via a predetermined air-gap between the driver coil and the magnet; and means for exciting the driver coil.

The rotating shaft has one end which is received in and held by the support member of the casing, so that the rotating shaft has a cantilevered construction On the other hand, the opposite end of the rotating shaft is resiliently urged by the urging means into abutting engagement with the rotating shaft thus supported. An alignment adjustment as required in the conventional aspirator fan is no longer needed. In addition, even when the casing is deformed, such deformation of the casing has no effect on the rotation of the rotating shaft and, hence, the impeller rotate stably without wobbling or generation of unpleasant noise.

The above and other objects, features and advantages of the present invention will become manifest to those versed in the art upon making reference to the detailed description and the accompanying sheets of drawings in which preferred structural embodiments incorporating the principles of the present invention are shown by way of illustrative examples.

DETAILED DESCRIPTION

The present invention will be described hereinbelow in greater detail with reference to certain preferred embodiments shown in the accompanying drawings.

Figure 1:
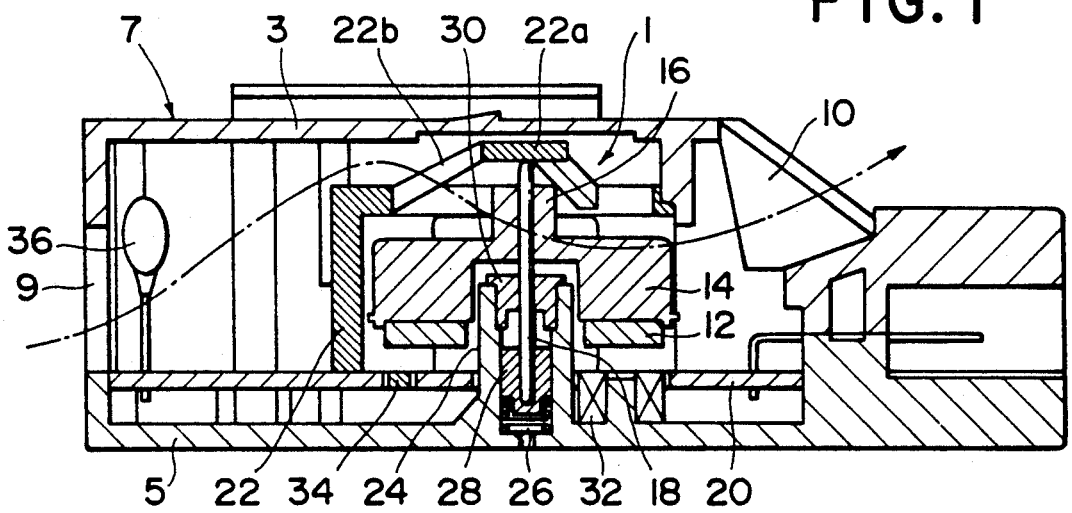
FIG. 1 is a vertical cross-sectional view of an aspirator fan according to this invention as it is disposed in a casing.
Figure 2:
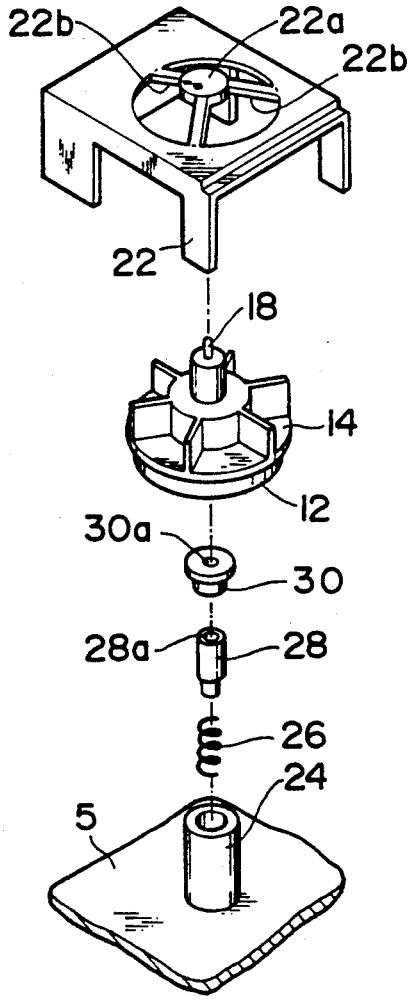
FIG. 2 is an exploded perspective view of the aspirator fan.

As shown in FIGS. 1 and 2, an aspirator fan 1 embodying the present invention is disposed in a casing 7 composed of an upper casing member 3 and a lower casing member 5 joined with the upper casing member 3. The casing 7 has an inlet 9 at the front side and an outlet 10 at the rear side. The front side of the casing 7 is connected to the instrument panel of a motor vehicle (not shown), with the inlet 9 being open to the passenger compartment of the motor vehicle.

The aspirator fan 1 generally comprises an annular or ring-shaped magnet 12, an impeller 14 to which the magnet 12 is secured, a rotational shaft 18 press-fitted in a central boss 16 of the impeller 14, a printed circuit board 20 disposed below the impeller 14, and a shaft abutment member 22 extending over and around the impeller 14 to substantially cover or enclose the impeller 14.

The impeller 14 is rotatably mounted in the casing 7 in such a manner that one end (lower end) of the rotating shaft 18 is received in and held by a support member 24 of the casing 7, while the opposite end (upper end) of the rotating shaft 18 is held in abutting engagement with the shaft abutment member 22. The magnet 12 is a field magnet having a multiplicity of magnetic poles arranged in the circumferential direction and produces a magnetic field acting on a driver coil 32 described later.

The support member 24 is a bottomed hollow cylinder and receives therein a compression coil spring 26, an urging assistance member 28 and a locking member 30 received in the order named. The urging assistance member 28 is urged by a force of the spring 26 in an upward direction toward the locking member 30. The locking member 30 is fitted into an open end of the support member 24 of the casing 7 so as to limit the upward movement of the urging assistance member 28. In assembly, one end (lower end) of the rotating shaft 18 passes through a central through-hole **30*a* (FIG. 2) in the locking member 30 and is then inserted into a central blind hole 28*a* (FIG. 2) in the urging assistance member 28 until it abuts against the bottom of the blind hole 28*a*. With this construction, the rotating shaft 18 is subjected to an upward urging force exerted from the spring 26 via the urging assistance member 28. The opposite end of the rotating shaft 18 being thus urged upwardly by the spring 26 is supported by the shaft abutment member 22** in a manner described below.

The shaft abutment member 22 is held by and between the upper casing member 3 and the printed circuit board 20 disposed on the lower casing member 5 and is disposed in a position confronting to the support member 24. The shaft abutment member 22 includes a shaft abutment portion 22*a* disposed above the support member 24 for abutting engagement with the opposite end of the rotating shaft 18. Since the rotating shaft 18 is urged upwardly by the spring 26 as described above, the opposite end of the rotating shaft 18 is resiliently urged against the shaft abutment portion 22*a* of the shaft abutment member 22 The shaft abutment member 22 is closed at a portion confronting to the inlet 9, while an upper wall of the shaft abutment member 22 has at least one air intake hole 22*b* (three in the illustrated embodiment) formed around the shaft abutment portion 22*a* for introducing air into an internal space of the shaft abutment member 22 in which the impeller 16 is disposed. The air introduced in the internal space is then forced out from a cutout recess or opening of the shaft abutment member 22 which faces toward the outlet 10.

The printed circuit board 20 is provided with the driver coil 32, a Hall-effect element 34, an exciting circuit (not shown) for exciting the driver coil 32 in response to an output signal from the Hall-effect element 34. The driver coil 32 is properly excited by the exciting circuit to generate an alternating magnetic field acting on the magnet 12. To this end, the driver coil 32 is disposed in confrontation to the magnet 12 secured to the impeller 14. The Hall-effect element 34 detects the position of the magnetic poles of the magnet 12 on the impeller 14 and delivers the output signal to the exciting circuit. The printed circuit board 20 is also provided with a temperature sensor 36 for detecting the temperature of the passenger compartment, the sensor 36 being disposed adjacent to the inlet 9.

When the aspirator fan 1 of the foregoing construction is driven, air inside the passenger compartment is drawn through the inlet 9 into the casing 7 as indicated by the arrow. In this instance, the temperature of the inside air is detected by the temperature sensor 36 for a proper control of an automotive air-conditioner.

As described above, one end of the rotating shaft 18 of the impeller 14 is received in and held by the support member 24 of the casing 7, while the opposite end of the rotating shaft 18 is held in abutment with the shaft abutment member 22 under a resilient force of the spring 26 acting on the one end of the rotating shaft 18. With this construction, it is no longer necessary to support the rotating shaft 18 at its opposite ends by bearings and thereby to adjust the alignment of the bearings.

The shaft abutment member 22 for supporting the opposite end of the rotating shaft 18 is structurally separated from the casing 7, so that even when the casing 7 is deformed due to some reasons, a deformation of the casing 7 has no effect on the position of the shaft abutment member 22. The rotating shaft 18 can, therefore, be rotated properly and smoothly without obstruction.

Figure 3:
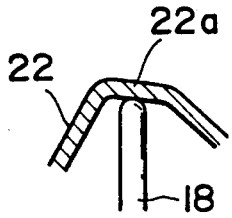
FIGS. 3 and 4 are cross-sectional views showing different modifications according to the present invention.
Figure 4:
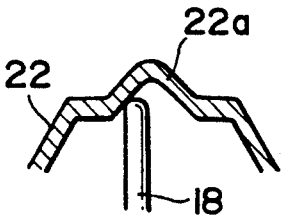

The shaft abutment portion 22*a* of the shaft abutment member 22 may be oblique and extend at a predetermined angle relative to an axis of rotation of the rotating shaft 18, as shown in FIGS. 3 and 4. With the oblique shaft abutment portion 22*a*, the rotating shaft 18 is subjected to a lateral pressure tending to automatically align the rotating shaft with a proper position, thereby enabling the impeller to rotate stably without causing run-out and unpleasant noise.

As described above, one end of a rotating shaft is received in and held by a support member of a casing in such a manner as to be a cantilever, while the opposite end of the rotating shaft is urged into resilient abutment against a shaft abutment member by means of a resilient member acting on the one end of the rotating shaft. This shaft-supporting structure obviate the need for the alignment between the rotating shaft and the bearings as required in the conventional aspirator fan.

In addition, since a shaft abutment member supporting the opposite end of the rotating shaft is structurally separated from the casing, a deformation of the casing has no effect on the rotation of the rotating shaft. The reliability of operation of the aspirator fan is thus improved.

Obviously, various modifications and variations of the present invention are possible in the light of the above teaching. It is therefore to be understood that within the scope of the appended claims the present invention may be practiced otherwise than as specifically described.

What is claimed is:

1. An aspirator fan, comprising:

(a) a casing having an inlet and an outlet;

(b) an impeller having a magnet secured thereto;

(c) a rotating shaft press-fitted in said impeller to support said impeller for co-rotation therewith;

(d) a support member formed on said casing and receiving therein one end of said rotating shaft;

(e) means disposed in said support member for urging said one end of said rotating shaft toward an opposite end of said rotating shaft;

(f) a shaft abutment member disposed in the casing and held in engagement with said opposite end of said rotating shaft being urged by said urging means; and (g) a driver coil confronting said magnet via a predetermined air-gap between said driver coil and said magnet.

2. An aspirator fan according to claim 1 wherein said urging means comprises an urging assistance member attached to said one end of said rotating shaft and a spring exerting a spring force on said urging assistance member.

3. An aspirator fan according to claim 1 wherein said casing is composed of an upper member and a lower member jointed with said upper member, said shaft abutment member being held by and between said upper casing member and a printed circuit board disposed on said lower casing member, said shaft abutment member having a shaft abutment portion held in abutment with said opposite end of said rotating shaft.

4. An aspirator fan according to claim 1 wherein said shaft abutment member includes a shaft abutment portion held in abutment with said opposite end of said rotating shaft at a predetermined angle of inclination.

5. An aspirator fan according to claim 1 wherein said inlet is defined at one side of said casing and said outlet is defined at the opposite side of said casing, further including a temperature sensor disposed within said casing adjacent to said inlet.

6. An aspirator fan according to claim 1 wherein said shaft abutment member extends over and around said impeller to substantially encloses the same, said shaft abutment member having an upper wall, at least one air intake hole formed in said upper wall, and a cutout recess facing to said outlet.

* * * * *